United States Patent [19]

Lane et al.

[11] 4,342,458

[45] Aug. 3, 1982

[54] MULTI-PLAYER BACKGAMMON

[76] Inventors: Rick Lane, 845 Arlingwood Ave., Jacksonville, Fla. 32211; Donald C. Kafka; Jayne M. Kafka, both of 108 Windsor St., Simpsonville, S.C. 29681

[21] Appl. No.: 188,358

[22] Filed: Sep. 18, 1980

[51] Int. Cl.[3] ..... A63F 3/00

[52] U.S. Cl. ..... 273/248

[58] Field of Search ..... 273/248, 287

[56] References Cited

U.S. PATENT DOCUMENTS

D. 84,477 6/1931 Hirtenstein ..... 273/248 X 4,058,318 11/1977 Thomas et al. ..... 273/248

OTHER PUBLICATIONS

*Games of the World* Ed., Fredric V. Grunfeld; ©1975, pp. 8, 9, 150–155.

*Primary Examiner*—Richard C. Pinkham

*Assistant Examiner*—Scott L. Brown

*Attorney, Agent, or Firm*—Marvin Feldman; Stephen E. Feldman; Steve T. Zelson

[57] ABSTRACT

A backgammon game is disclosed which accomodates simultaneously two to four players at 10 pieces, men or stones per player, and which gameboard is comprised of four quadrents or tables with seven playing points per table. The 10 pieces in a set are similarly colored, and each set is of a color different from each other set. All the points in a particular quadrant are similarly colored, and the color of the points in each particular quadrant differ from the color in each other quadrant. The color of the points in each quadrant corresponds to the color of the pieces in one of the sets. The backgammon game permits multiple play by four players without a cumbersome board structure and without an unwieldly number of stones per player.

11 Claims, 1 Drawing Figure

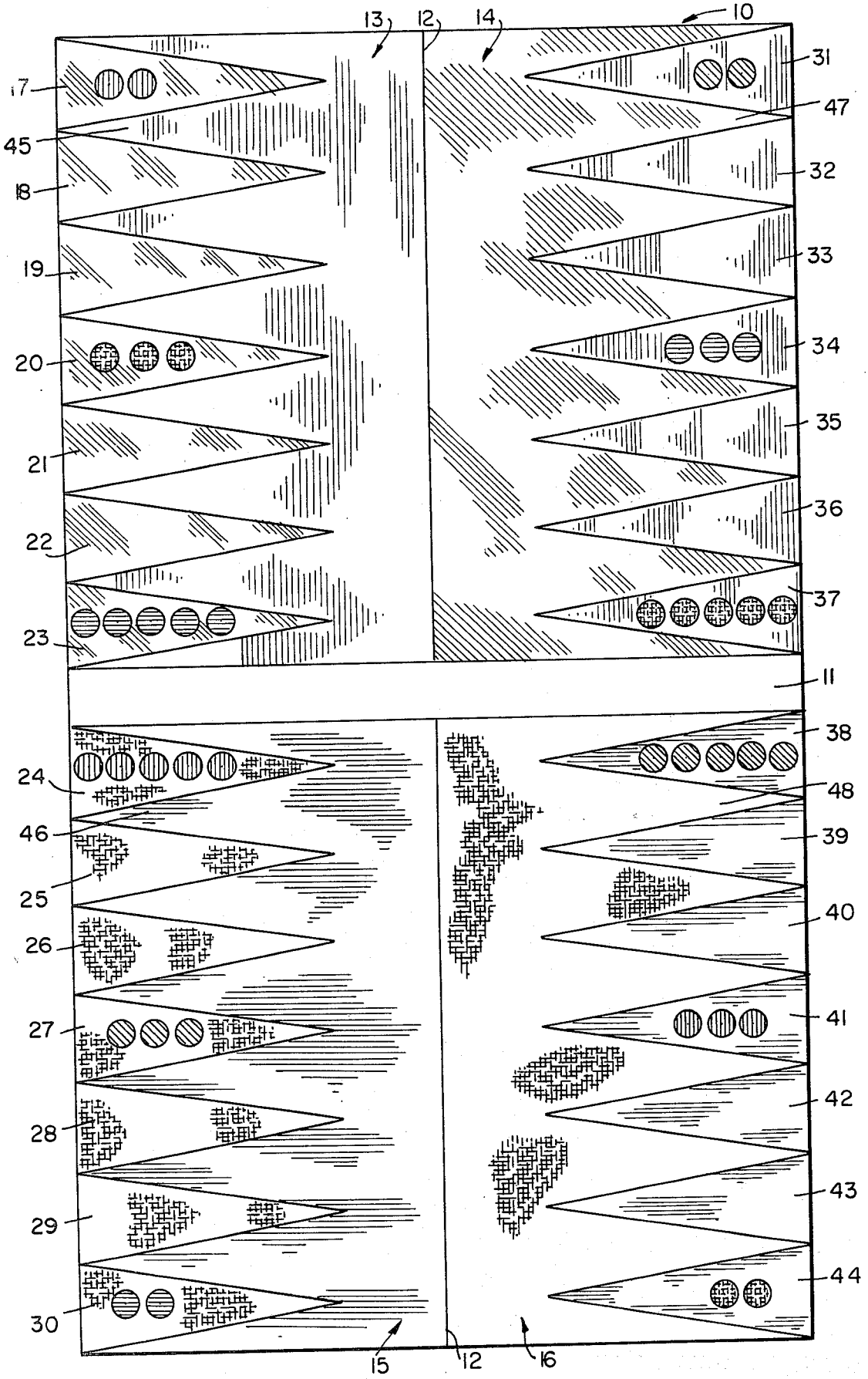
10
13
12
14
17
45
18
19
20
21
22
23
31
47
32
33
34
35
36
37
11
38
48
39
40
41
42
43
44
24
46
25
26
27
28
29
30
15
12
16

MULTI-PLAYER BACKGAMMON

FIELD OF THE INVENTION

This invention relates to the field of amusement devices. Specifically this invention relates to backgammon games.

BACKGROUND OF THE INVENTION

Backgammon, a board game, has traditionally been played by two persons. The backgammon playing board used for this ancient game is arranged with 24 positions or playing points over which the players alternately move their respective 15 men, pieces or stones according to the roll of dice. The board itself is divided into four quadrents or "tables", with two tables per side and six triangular points per table. The basic object of the game is to be the first player to remove all of his pieces from the table. The pieces of the two players are moved in opposite directions around the board. Initially, each player has eight pieces on his home side or home table and seven pieces on the opposite side or outside table.

The prior art shows attempts to permit backgammon to be played by more than two people at one time. One means of achieving this is known as chouette. In this variation of backgammon, however, not all of the players are of equal status and the game becomes more of a team, not individual, effort.

Other means of achieving play by more than two people are shown in U.S. Pat. No. 4,124,212 granted Nov. 7, 1978; U.S. Pat. No. 4,058,319 granted Nov. 15, 1977; and U.S. Pat. No. 4,058,318 granted Nov. 15, 1977. All of these patents permit the inclusion of more than 2 but not greater than 4 players of equal status. This increase, however, usually required a significant distortion of the traditional and simple backgammon game board. U.S. Pat. No. 4,058,318 allows more than two players by doubling the traditional gameboard size from 24 points to 48 points.

U.S. Pat. No. 4,085,319 permits more than two players by increasing board size from 24 up to 60 playing points and by completely rearranging the layout of the backgammon quadrents or tables.

U.S. Pat. No. 4,124,212 also increases the playing points from 24 to 45 so as to allow for more than two players. This prior art also significantly rearranges the layout of the backgammon gameboard quadrents or tables, and further, redesigned the traditionally shaped triangularly shaped playing points into diamond-like designs. These changes, in toto, are so profound as to render this gameboard virtually unrecognizable as a backgammon gameboard and also make it cumbersome in play.

Now there is provided by the present invention a multi-player backgammon game which eliminates the complex and cumbersome play of prior art multi-player games, while retaining the character of the traditional two-player game. This new and unique gameboard allows more than two people to play backgammon within the context of traditional backgammon play without having to acquaint oneself with a confusing table arrangement or contend with an inordinately large and confusing number of pieces on the gameboard.

It is therefore an object of this invention to provide a backgammon game which allows for the simultaneous playing of up to four people and yet which includes the convenience in gameboard layout and ease of understanding of the traditional two player backgammon gameboard.

It is another object of this invention to provide a gameboard for the simultaneous playing of backgammon by up to four people without having any of the four people team-up and wherein all of the players are of equal status and wherein traditional backgammon strategies may be used.

It is a further object of this invention to provide for a backgammon game which will accomodate up to four players with only 40 playing pieces at 10 pieces per player without the confusion and clutter created by the up to 60 playing pieces present in the prior art.

It is another object of this invention to provide a backgammon game which simultaneously accomodates up to four players and, which for ease of identification, both the gameboard and playing pieces are coordinately color coded.

It is still a further object of this invention to provide a backgammon game which when played with a chouette variation, accomodates simultaneously up to 10 players.

The aforesaid as well as other objects and advantages will become apparent from a reading of the following specification, the adjoined claims and the accompanying drawings.

DESCRIPTION OF THE DRAWINGS

FIG. 1 is a plan view of the backgammon gameboard with pieces arranged for playing four people simultaneously.

DESCRIPTION OF PREFERRED EMBODIMENTS

Referring to FIG. 1 there is shown the plan view of the backgammon gameboard generally identified as 10. The gameboard is bisected widthwise by dividing bar 11. The gameboard is further bisected lengthwise by line border 12 into four quadrents or tables generally indicated as 13, 14, 15 and 16. Said tables each include as first indicia thereon seven playing points and include as second indicia thereon a background area. Further, each of the playing points are one of four colors and correspond with one of the four background areas. Which four specific colors are chosen is purely an arbitrary selection and has no bearing on the claimed invention.

On table 13 the playing points are indicated by 17, 18, 19, 20, 21, 22 and 23 and the background area is indicated by 45. Playing points 17, 18, 19, 20, 21, 22 and 23 color correspond with background area 47 in table 14.

On table 14 the playing points are indicated by 31, 32, 33, 34, 35, 36, 37 and color correspond with background area 45 on table 13. The background area on table 14 is indicated by 47.

On table 15 the playing points are indicated by 24, 25, 26, 27, 28, 29 and 30 and color correspond with the background area 48 on table 16. The background area on table 15 is indicated by 46.

On table 16 the playing points are indicated by 38, 39, 40, 41, 42, 43 and 44 and color correspond with background area 46 on table 15. The background area in table 16 is indicated by 48.

Referring to FIG. 1 there is also shown a typical playing piece, stone or man arrangement in order to accomodate four players. This arrangement is indicated by the variously colored circles on the playing points.

In the most preferred embodiment of this invention each player receives ten of these playing pieces. A playing piece may be one of four colors, said four colors preferably being selected from the colors of the gameboard and thereby become color coordinated with said gameboard. The exact color chosen for the playing piece is purely an arbitrary selection and has no bearing on the claimed invention, although whatever color is selected would color correspond with selected playing points and background areas on the gameboard.

When the gameboard is set up to accomodate four players simultaneously, pieces are placed in specific locations as shown in FIG. 1 and described as follows:

Player #1, whose green pieces color correspond with the playing points of table 13, has 3 pieces of playing point 27, 5 pieces on playing point 38 and 2 pieces on playing point 31. Player #2, whose red pieces color correspond with the playing points of table 14, has 2 pieces on playing point 17, 5 pieces on playing point 24 and 3 pieces on playing point 41. Player #3, whose blue pieces color correspond with the playing points of table 16, has 5 pieces on playing point 23, 2 pieces on playing point 30 and 3 pieces on playing point 34. Player #4, whose yellow pieces color correspond with the playing points of table 15, has 3 pieces on playing point 20, 2 pieces on playing point 44 and 5 pieces on playing 37. In order to set up the gameboard so as to accomodate three players simultaneously, the positions of the pieces for players #1, #2 and #3 are the same as when the gameboard is set up to accomodate 4 players and, further, player #4's pieces are left off of the gameboard.

The movement of the play, determined by a random number generating device such as a die or dice, is such that each player moves his men from is primary opponent's inner table to his secondary opponent's inner tables, into his own inner table, and ultimately off the board. Player #1 will, therefore, respectively move his pieces in the direction from table 14 to 16 to 15 to 13. Player #2 will move his pieces in the direction from table 13 to 15 to 16 to 14. Player #3 will move his pieces in the direction from table 15 to 13 to 14 to 16. Player #4 will move his pieces in the direction from table 16 to 14 to 13 to 15.

In terms of actually playing the game, the backgammon procedures and rules set forth below may be applied.

Each player shall roll one die to determine who moves first. The player with the highest number showing on his die gets to determine his own combination using his die and any other player's die (no doubles). Play then rotates counter clockwise, each player using his own die. A player moves his pieces or men around the boards playing points according to the numbers shown on the dice. Cocked dice means that one of the dice has not landed completely flat on the playing board. When this happens the player must throw again. Moves shall be one move for each die or a player can move one man the total sum of the dice as long as the playing points designated by each die are open. Both numbers on each roll must be used when possible. If only one die can be used, it must be the larger of the two if possible. If the player cannot use his move at all, he must pass to his opponent.

"Doublets" mean rolling doubles, i.e., the same number is thrown on both dice. When this occurs a player moves the number shown on one die four times. A player can move the same man all four moves, or any other combinations of men desired.

Once a player lands two or more of his pieces on a playing point he is said to have "made the point". No other player may land on said playing point although they may pass over it. This is a "blocked point". There is no limit to the number of men one player may have on a point.

Any point on which a player has only one piece is a blot. If a player lands on his primary opponent's blot, he removes that piece to the dividing bar 11 and replaces it with his own. This is called a "hit". If player lands on his secondary opponent's blot, the hit piece moves back to the first available playing point (an available playing point is any playing point that is not blocked). This is called a "bump". A bump can result in a hit. If in the event a player's backward movement carries it beyond his point of entry he must then go back to the dividing bar. As an example, if #1 player's piece moves and hits #2 player's piece (primary opponent), #2 player's piece goes on the dividing bar 11. If #1 player's piece hits any other player's piece, but #2's (secondary opponent) then that piece goes back to the first available playing point. When playing with three players, all bumps go back to the dividing bar 11 because all three are primary opponents.

The dividing bar 11 is the middle strip that separates the inner and outer tables and bisects the board widthwise. Once one of a player's pieces has been placed on the bar, he must throw the dice, when his turn occurs, and must "enter" into his primary opponent's inner table before he may move any of his other pieces, Entering is accomplished by moving the piece on the dividing bar 11 to the playing point indicated on either one of the die thrown as long as that point is not blocked. If he cannot enter because both playing points indicated are blocked, the turn passes to his opponent. When all playing points within the primary opponent's inner table are blocked a closed board or shutout occurs.

Bearing Off means removing a player's pieces from the playing board by the roll of the dice. A player cannot start bearing off until all 10 of its pieces are in his inner table. He may then either bear off pieces from points corresponding to die thrown or he may move his pieces within his inner table according to the numbers shown on the dice. He must use his entire roll, if possible. This means that if he rolls a six, but has no piece on his six playing point, he must take off the highest point on which he does have pieces. The same rule applies if he rolls doubles. However, he cannot bear off a man if the playing point indicated on the die is vacant and there are any pieces on a higher counting playing point. If while bearing off, a piece in a player's inner table is "hit" by a primary opponent or bumped into the outer table by a secondary opponent, the player must re-enter the board and/or inner table before he can continuing bearing off.

A doubling cube is used to double the betting stakes. Before the game begins the doubling cube is placed on dividing bar 11 with the number 64 on top and not facing any player. If there is an automatic double the number 2 is placed face up, again not facing any player. If there is second automatic double the number 4 is placed face up, and so on. Automatic doubling occurs on each tie of primary opponents in the opening throw. Voluntary doubling means that a player offers to double the stakes, when it is his turn to play and before he has thrown the dice. A double may be accepted or declined, but the primary opponent declining looses whatever the stakes were before the double was offered. Thereafter, doubling alternates between primary opponents.

A game is won when any one player bears off all of his pieces first. A gammon II (double game) is won if a player's opponents have not born off any of their pieces. A backgammon II (triple game) is won if a player's opponents have not born off any of their pieces and have one or more pieces in their primary opponent's inner table or on the dividing bar 11.

Chouette allows for the inclusion of up to but not more than 10 players in the game. All players roll a die to determine who will be the "men in the box". This honor goes to the players rolling the highest two consecutive or equal numbers, while the players rolling the second highest two consecutive or equal numbers are the captains. In the event of a three or four way tie, among the highest four rolls, all four players roll again. All other players are the captain's partners and rank below the captains according to their roll of the die. The men in the box (primary opponents) and the captains (secondary opponents) play a four-handed game, but the captain's partners give advise for play. If either men in the box looses he then becomes the lowest ranking partner to his new captain. The winning captains become the men in the box. If the man in the box wins then the captain becomes the lowest ranking partner and the previously highest ranking partner becomes that captain.

In the drawings and specification, there has been set forth a preferred embodiment of the invention and although specific terms are employed, they are used in a descriptive sense only and not for purposes of limitation.

Inasmuch as many changes could be made in the above construction, and many apparently different embodiments of the invention could be made without departing from the scope thereof it is intended that all matter contained in the above description or shown in the accompanying drawings shall be interpreted as illustrative and not in a limiting sense.

What is claimed is:

1. A backgammon game for simultaneous playing of up to four people, comprising:

a. a gameboard having a rectangular shape wherein said rectangular area comprises quadrant;

b. said gameboard consisting of seven playing points per quadrant;

c. further comprising four sets of 10 playing pieces, each set having a different indicia; and d. a random number generating device; and wherein all points in each quadrant have an indicia corresponding to the indicia on the playing pieces in one of the sets; each quadrant points' indicia being different from the other quadrant points' indicia.

2. The game of claim 1, wherein said gameboard is divided widthwise by a dividing bar and lengthwise by a line border into four quadrants.

3. The game of claim 2, wherein said quadrants are of equal dimensions.

4. The game of claim 2, said indicia comprising color and wherein each quadrant comprises one color for the player points and a different color for the background.

5. The game of claim 2, wherein playing points are aligned side to side along the edge of said gameboard and face and oppose the playing points located in the quadrant adjoining its line border.

6. The game of claim 1, said indicia comprising color wherein said gameboard is comprised of four different colors.

7. The game of claim 1, wherein the random number generating device is a pair of dice.

8. The game of claim 1, wherein the playing points are triangular in shape.

9. The game of claim 1, further comprising a doubling cube.

10. A backgammon game for simultaneous playing of up to four people, comprising:

a. a gameboard having a rectangular shape wherein said rectangular area comprises quadrants;

b. said gameboard consisting of seven playing points per quadrant, said gameboard comprising a background for said playing points;

c. and comprising four sets of 10 playing pieces, each set having a different color; and d. a random number generating device; wherein said gameboard is divided widthwise by a dividing bar and lengthwise by a line border into four quadrants, wherein each quadrant comprises one color for the player points and a different color for the background, wherein only four colors define all the playing points, background for the playing points and playing pieces.

11. THe game of claim 10, wherein the color of the playing points of one quadrant is the same color as the background area of its adjoining quadrant on the same side of the dividing bar.

* * * * *